US006836247B2

(12) United States Patent
Soutiaguine et al.

(10) Patent No.: US 6,836,247 B2
(45) Date of Patent: Dec. 28, 2004

(54) ANTENNA STRUCTURES FOR REDUCING THE EFFECTS OF MULTIPATH RADIO SIGNALS

(75) Inventors: Igor Soutiaguine, Moscow (RU); Dmitry Tatarnikov, Moscow (RU); Vladimir Philippov, Moscow (RU); Anton Stepanenko, Yujnoukrainsk (UA); Andrey Astahov, Moscow (RU)

(73) Assignee: Topcon GPS LLC, Pleasanton, CA (US)

( * ) Notice: Subject to any disclaimer, the term of this patent is extended or adjusted under 35 U.S.C. 154(b) by 0 days.

(21) Appl. No.: 10/251,349

(22) Filed: Sep. 19, 2002

(65) Prior Publication Data

US 2004/0056803 A1 Mar. 25, 2004

(51) Int. Cl.[7] ..... H01Q 1/38
(52) U.S. Cl. ..... 343/700 MS; 343/846
(58) Field of Search ..... 343/700 MS, 846, 343/848, 702, 872; H01Q 1/38

(56) References Cited

U.S. PATENT DOCUMENTS

| | | | |
|---|---|---|---|
| 4,072,952 | A | 2/1978 | Demko |
| 4,721,966 | A | 1/1988 | McGrath |
| 4,899,164 | A | 2/1990 | McGrath |
| 4,922,259 | A | 5/1990 | Hall et al. |
| 4,992,799 | A | 2/1991 | Garay |
| 5,592,174 | A | 1/1997 | Nelson |
| 5,594,455 | A | 1/1997 | Hori et al. |
| 5,694,136 | A | 12/1997 | Westfall |
| 5,752,204 | A | 5/1998 | Epperson et al. |
| 5,898,405 | A | 4/1999 | Iwasaki |
| 5,986,615 | A | 11/1999 | Westfall et al. |
| 6,014,144 | A | 1/2000 | Nelson et al. |
| 6,049,309 | A | 4/2000 | Timoshin et al. |
| 6,100,855 | A | 8/2000 | Vinson et al. |
| 6,121,932 | A | 9/2000 | McCoy et al. |
| 6,160,514 | A | 12/2000 | Judd |
| 6,198,439 | B1 | 3/2001 | Dufrane et al. |
| 6,219,002 | B1 | 4/2001 | Lim |

OTHER PUBLICATIONS

D. H. Schaubert, "A review of Some Microstrip Antenna Characteristics," Chapter 2 in "Microstrip Antennas" edited by David M. Pozar and D. H. Schaubert, pp. 59–67, 1995.

Thomas H. Lee, "Chapter 1. Antennas," Stanford EE414 Handout #13, Stanford University, pp. 1–22, Apr. 2001.

*Primary Examiner*—Hoanganh Le
(74) *Attorney, Agent, or Firm*—Sheppard Mullin Richter & Hampton LLP

(57) ABSTRACT

Compact antenna systems for reducing the reception of multipath signals are disclosed. An exemplary antenna system comprises a ground plane, a receiving antenna disposed above the ground plane and providing an output signal of the antenna system, and a passive antenna disposed below the ground plane.

47 Claims, 6 Drawing Sheets

ANTENNA STRUCTURES FOR REDUCING THE EFFECTS OF MULTIPATH RADIO SIGNALS

FIELD OF THE INVENTION

The present invention relates to antennas, and more particularly to antennas for radio-signal navigation systems, such as global positioning systems, where it is desirable to reduce the effects of multipath signals.

BACKGROUND OF THE INVENTION

Satellite navigation systems include the global positioning system (GPS) and the global orbiting navigation system (GLONASS). The systems are used to solve a wide variety of tasks that relate to determining object position, object velocity, and precise time. Land surveying is an important application of receivers based on satellite navigation systems. Such receivers have many advantages compared to conventional devices for land surveying. For example, satellite-based surveying systems are more responsive, can operate in nearly all types of weather and at all times of the day, and can be used in areas which do not have line-of-sight conditions.

However, there are some drawbacks to satellite navigation systems. These systems typically receive signals from four or more satellites and extract timing information from the satellite signals. Using three-dimensional triangulation, the position coordinates of the antenna receiver element can be determined from the extracted timing information. There are many sources of error that enter into the extraction and triangulation process, which in turn cause errors in the computed coordinates. One large error source arises from the reception of reflected versions of the satellite signals. These versions are reflected from the ground and neighboring objects and have timing information which is different from that contained in the true satellite signals. The total signal received by the antenna and measured by the receiver will be a combination of the true satellite signal and the reflected versions, and the final timing information extracted by the receiver will be a combination of the timing information of the true signal with that of the reflected versions. The resulting error in the computed coordinates can be several meters for stand-alone processing, and several centimeters for differential GPS processing (DGPS).

Multipath errors can be addressed at the receiver level by including circuits which detect and reject or mitigate multipath signals. Multipath errors can also be addressed at the antenna level, where the reception of mulitpath signals by the antenna element is reduced. This is the area that the present invention is directed to.

Reducing the reception of multipath signals can be accomplished by constructing an antenna system that provides a good "down/up ratio" (also known as the "front to back ratio"). Such antenna systems typically use a large ground plane underneath the antenna element to define a horizontal antenna plane, and are constructed to strongly decrease signals received from below the horizontal antenna plane, and hence decrease the effect of multipath signals caused by the Earth's surface and other objects underneath the antenna.

The "down/up ratio" is one of the most important parameters of a radio-navigation antenna, and is very useful in describing the ability of the antenna system to suppress reflections from the ground. We give a brief description of the ratio here, and a more detailed explanation in Appendix B. Normally, an antenna system is mounted on a pole which is positioned over a target point, with the axis of the pole being substantially collinear with the direction of gravitational pull at the target point. We will refer to this direction of gravitational pull as the plumb-position axis. In this configuration, the ground plane of the antenna is perpendicular to the plumb-position axis, and parallel to the horizontal plane that extends from the target point to the horizon in all directions. Suppose that we have a true satellite signal incoming to the antenna element at an elevation angle $\theta$ with respect to the horizontal plane. Since the true satellite signal is in the form of plane waves, it strikes the antenna ground plane at an angle $\theta$ with respect to the plane of the ground plane, and it strikes the Earth's ground at an angle $\theta$ with respect to the horizontal plane. Some of the signal striking the Earth reflects off the Earth's ground at an angle $\theta$ with respect to the horizontal plane, and propagates toward the underside of the antenna system. The reflected signal also strikes the underside of the antenna system (usually the ground plane) at an angle of $-\theta$ with respect to the plane of the antenna ground plane. This reflected signal propagates around the surface of the antenna system toward the antenna element at the top surface, and a portion thereof is received by the antenna element, along with the true satellite signal. The amount of the reflected signal that is received by the antenna element generally depends upon the angle $-\theta$ (as measured with respect to the plane of the antenna ground plane). As can be seen from the above, the level of reflected signal received by the antenna depends upon two factors: one is the reflection coefficient from the Earth and the other is the antenna's directivity. While the first factor depends on the Earth's properties and the antenna's location, the second factor is determined only by the properties of the antenna system. The second factor can be characterized in terms of the down/up ratio. The down/up ratio is the ratio of the signal reception of a signal directed toward the underside of the antenna system with angle $-\theta$ and power level Po to the signal reception of a signal directed toward the topside of the antenna system with angle $\theta$ and power level Po. Angle $\theta$ is generally called the elevation angle.

In general, the down/up ratio of an antenna system is principally determined by size and shape of the ground plane. Ideally, a flat metal ground plane of infinite extent would provide perfect suppression of signals received from below the horizontal antenna plane. In practice, many antenna systems employ large ground planes to provide good down/up performance. Among them is the well known GPS "Choke Rings," which are ground planes which comprise several concentric grooves formed on the top surface of the ground plane. They are widely used in high precision GPS/GLONASS applications and provide good multipath rejection performance. The typical diameter of the ground planes in these systems is on the order of 30 cm to 50 cm, and so their use in portable radio-navigation equipment is rather limited because of their bulky nature. They are most often used as part of the antennas for base stations.

For the rover stations, one would like to use microstrip antennas because of their small size and manufacturability. However, these antennas have poor down/up ratios, and have very little multipath suppression capability.

The present invention is directed to providing an antenna system which is compact, and yet has good down/up ratios and good multipath suppression.

SUMMARY OF THE INVENTION

Broadly stated, the present invention comprises a receiving antenna and a passive antenna disposed in close proximity to one another, with the signal received by the receiving antenna being provided for processing or transmission, without any significant direct coupling of the signal received by the passive antenna.

In preferred configurations, the two antennas are mounted back to back, with their ground planes facing one another, or with their antenna elements disposed on opposite sides of a common ground plane or common grounded enclosure.

The inventors have found that this structure greatly improves the down/up performance of microstrip antennas having small ground planes.

As an unexpected benefit, the inventors found that the bandwidth of the antenna system is significantly increased, thereby enabling the antenna system to receive both differential correction signals transmitted on the INMARSET frequencies (1530 MHz) and the global positioning satellite signals (1560 MHz to 1610 MHz).

In another aspect of the present invention, two or more receiving antennas may be stacked above one another to provide an antenna system that can receive antenna signals from multiple bands with high gain. In a further aspect of the present invention, two or more passive antennas may be stacked upon one another to provide increased multipath suppression in multiple frequency bands. In yet a further aspect, an antenna system may comprise two or more receiving antennas stacked over one another to provide the benefits as described above, and two or more passive antennas stacked upon one another to provide the benefits as described above.

Accordingly, it is an object of the present invention to improve the down/up ratio of small microstrip antennas.

It is another object of the present invention to enable the construction of small antennas for receiving global positioning satellite signals which have the same or better multipath rejection performance as antennas with large ground planes or complex choke ring systems.

It is another object of the present invention to enable the bandwidth of microstrip antennas to be increased.

It is still another object of the present invention to enable the construction of an antenna which can receive both global positioning satellite signals and INMARSAT correction signals and/or other similar correction signals with good performance.

These and other objects of the present invention will become apparent to those skilled in the art from the following detailed description of the invention, the accompanying drawings, and the appended claims.

DETAILED DESCRIPTION OF THE INVENTION

Figure 1:
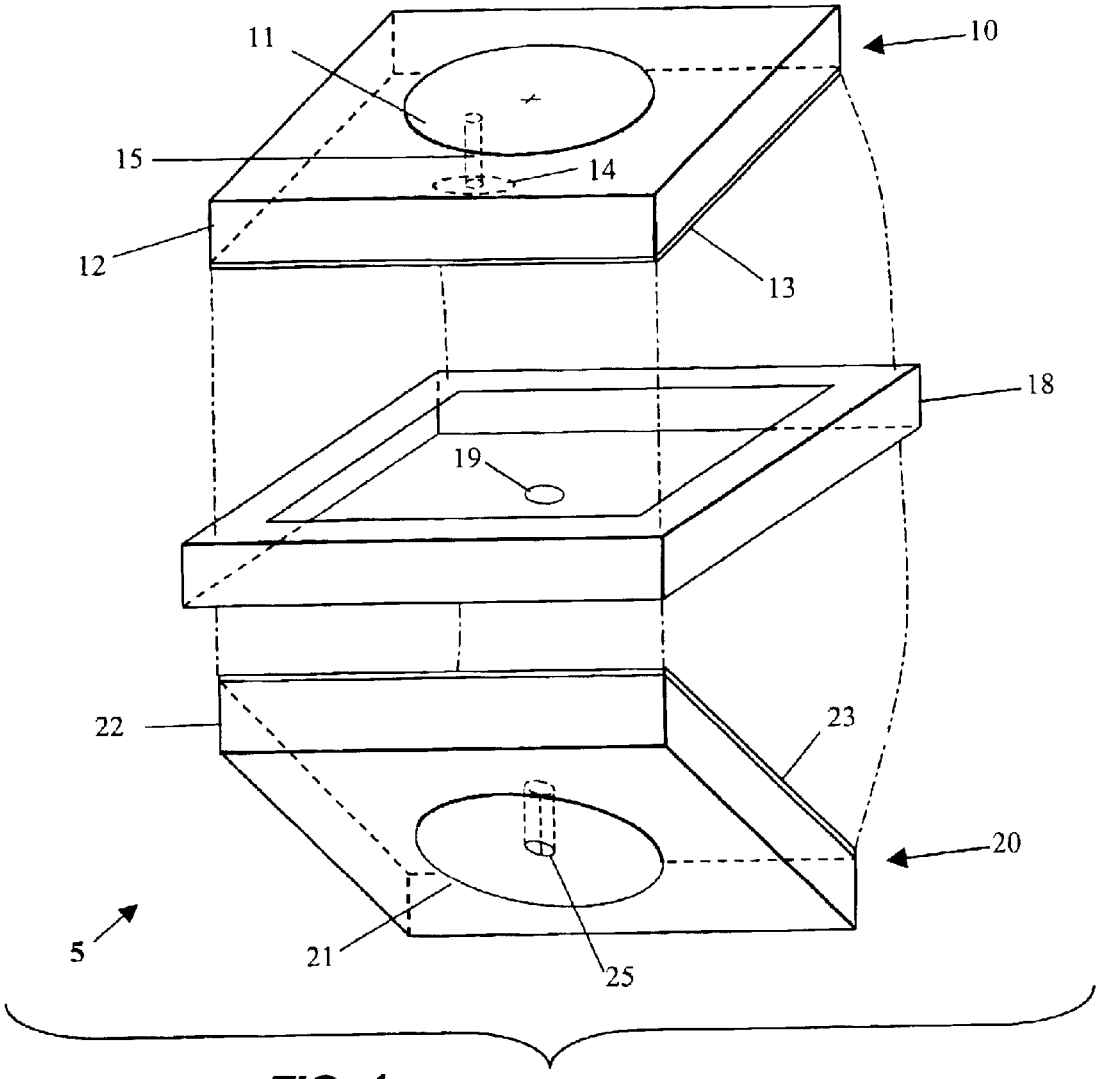
FIG. 1 is an exploded perspective view of a first exemplary embodiment of an antenna system according to the present invention.

FIG. 1 shows an exploded perspective view of a first exemplary embodiment 5 of an antenna system according to the present invention. The system 5 comprises a signal receiving antenna 10, a grounded enclosure 18 for containing a low-noise amplifier (LNA), and a passive antenna 20. Because of strong mutual electromagnetic coupling between the receiving antenna and the passive antenna, the directivity and multipath suppression capability of such an antenna system differs from that of the receiving antenna alone.

Receiving antenna 10 comprises a dielectric substrate 12 having a first surface and a second surface, an antenna element 11 disposed on at least a portion of the first surface of substrate 12, and a conductive ground plane 13 disposed on the second surface of substrate 12. Antenna element 11 and ground plane 13 collectively comprise a conventional patch antenna configuration. In general, ground plane 13 extends over the same amount of area or more as antenna element 11, and covers a portion or all of the second surface of dielectric substrate 12. However, it is possible for ground plane 13 to cover a lesser amount of area than antenna element 11. Receiving antenna 10 further comprises a conductive feed lead 15 formed from antenna element 11 through dielectric substrate 12 and extending to at least the second surface of substrate 12. Feed 15 may extend out past the second surface of substrate 12. An aperture 14 is formed in ground plane 13 to conductively isolate feed lead 15 and ground plane 13 (i.e., to prevent a direct current path between lead 15 and plane 13). Aperture 14 is preferably located concentrically about lead 15 to form a coaxial interface and a signal port. As described in greater detail below, an input to a low-noise amplifier is preferably coupled to this coaxial interface, with the amplifier being housed within grounded enclosure 18. In other embodiments, a coaxial transmission line may be coupled to the coaxial interface.

Passive antenna 20 comprises a dielectric substrate 22 having a first surface and a second surface, an antenna element 21 disposed on at least a portion of the first surface of substrate 22, and a conductive ground plane 23 disposed on the second surface of substrate 22. Antenna element 21 and ground plane 23 collectively comprise a conventional patch antenna configuration. In general, ground plane 23 extends over the same amount of area or more as antenna element 21, and covers a portion or all of the second surface of dielectric substrate 22. However, it is possible for ground plane 23 to cover a lesser amount of area than antenna element 21. Passive antenna 20 further comprises a through-hole 25 formed through dielectric substrate 22 from antenna element 21 to grounding plane 23. As indicated below, through-hole 25 is provided to enable a cable to be routed from grounded enclosure 18 to the outside environment. In general, through-hole 25 is plated with conductive material and forms a conductive path between the center of antenna element 21 and ground plane 23. The plated conductive material minimizes the impact that the cable would have on the operation of passive antenna 20. However, if the cross-sectional area of through-hole 25 is 15 to 20 times smaller than the area of antenna element 21, then the inner surfaces of through-hole 25 can be un-plated since such a small cross-sectional area will have little effect on the operation of the passive antenna. It may be appreciated that each plated through-hole, lead, and trace described herein provides a conductive path.

Figure 2:
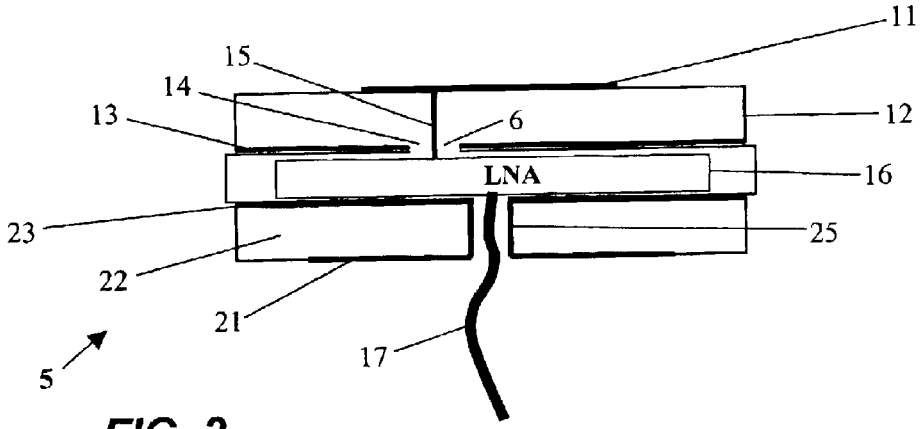
FIG. 2 is a cross-sectional view of the first exemplary embodiment shown in FIG. 1 according to the present invention.

Grounded enclosure 18 is preferably used to house and electrically shield a low-noise amplifier 16 (LNA), which is generally shown in the cross-sectional view of FIG. 2. A number of options for providing the LNA 16 are available. A hermetically sealed LNA may be bonded to ground plane 13 of receiving antenna 10. Depending on the configuration of the electrical input of the LNA 16 and the desired performance characteristics of the antenna system, a wire, a capacitor, an impedance-matching component, or an impedance-matching network may be used to couple the tip of lead 15 to the input of LNA 16. The output of the LNA may then be coupled to a coaxial line 17, which in turn is routed to the outside environment. As another option, a miniature circuit board carrying the LNA components may be bonded to ground plane 13, and a wire, a capacitor, an impedance-matching component, or an impedance-matching network may be used to electrically couple the tip of lead 15 to the input of the miniature circuit board. The output of the miniature circuit board may then be coupled to coaxial line 17, which in turn is routed to the outside environment.

Referring to FIG. 1, enclosure 18 generally comprises a thin box with a bottom, one or more sides, and an open top with a thin lip formed around the perimeter of the top, with the lip being attached to the side(s) of the box. The thin box of enclosure 18 may comprise a single side and have the shape of a thin disc, or may have two or more sides having a shape of an oval or polygon. A square shape is shown in FIG. 1. The bottom, side(s), and top lip of enclosure 18 may all be entirely formed of metal, or may be formed of a composite material that has a conductive outer skin. Ground plane 13 of receiving antenna 10 is positioned over the top lip of enclosure 18, and sealed thereto, preferably by a metal-based solder. In a similar manner, ground plane 23 of passive antenna 20 is positioned over the bottom of enclosure 18, and sealed thereto, preferably by a metal-based solder. The solder may be applied along the edges of the bottom of enclosure 18, or may be applied over the entire area of the bottom. An aperture 19 is formed in the bottom of enclosure 18. Aperture 19 is aligned to through-hole 25 to provide a clear passage for cables (e.g., coaxial line 17) to exit enclosure 18. As another implementation, the bottom of enclosure 18 may have the open structure like that of the top of enclosure 18, with a corresponding bottom lip that is sealed to the outer perimeter of ground plane 23.

Power may be provided to LNA 16 by superimposing a DC voltage on the inner core of coaxial line 17, and separating the DC voltage from the received antenna signal with filters within LNA 16. This technique is well known to the art, and a description thereof is not needed in order to make and use the present invention. Ground potential may be provided by the outer ground shield of coaxial line 17. As other options, a separate power line and/or a separate ground line may be provided in or along with coaxial line 17.

While the use of LNA 16 is preferred, it may be omitted for some embodiments. In this case, enclosure 18 provides room for coaxial line 17 to be routed to lead 15. As indicated below, lead 15 is offset from the center of antenna element 11 to achieve a certain level of input impedance, and to enhance reception of right-hand circularly polarized (RHCP) satellite signals. If LNA 16 is omitted, enclosure 18 may be replaced by a circuit board which provides the routing, and which electrically couples the two antenna ground planes 13 and 23 together. Also, a simpler overall structure may be used, as illustrated at 50 in FIG. 3. In this embodiment, a single ground plane 53 is used in place of ground planes 13 and 23. Substrate 12 may be adhered to ground plane 53 with an adhesive, or the entire structure may be integrally formed, such as done in a multi-laminated printed circuit board. Coax line 17 is inserted into through-hole 25, with its tip end soldered to lead 15, and the outer insulation around the coax shield is removed so that a small exposed portion of the shield may be soldered to the plated surface of through-hole 25. Alternatively, a coax-cable connector may be integrated into the structure to provide a connection point for coax line 17. For example, such a connector may be soldered to lead 15 before substrate 12 is adhered to ground plane 53, and the ground shield of the connector may thereafter be soldered to through-hole 25.

As yet another implementation, an LNA may be used with embodiment 50 by attaching a miniature circuit board carrying the LNA components to the patch of passive antenna element 21.

In the above preferred examples, whether or not LNA 16 is used, lead 15 and the nearest ground plane provide a signal port at which the received antenna signal is made available for processing by the LNA or for transport by cable to an external LNA or processor. This signal port is indicated by reference number 6 in FIGS. 2 and 3. Either LNA 16 or coax line 17 is coupled to signal port 6. Since antenna element 11 of the receiving antenna is conductively coupled to lead 15, it is in turn conductively coupled to signal port 6. In contrast, antenna element 21 of passive antenna 20 is not conductively coupled to lead 15, and therefore is conductively isolated from (i.e., not conductively coupled to) signal port 6. As used herein, "conductively isolated" means that there is no direct current (DC) path from antenna element 21 to the lead 15 of signal port 6. Thus, the degree of electrical coupling (e.g., signal feeding) between the receiving antenna element and the signal port (and LNA or coax line) is greater than the degree of electrical coupling between the passive antenna element and the signal port (and LNA or coax line).

While the above-described embodiment uses a coax feeding construction with feed lead 15 conductively coupled to the radiation element (element 11) and conductively isolated from other antenna elements such as antenna element 21, other embodiments of the present invention may use other feeding constructions that are known to the art. Examples of other feeding constructions are: microstrip line feeding, proximity coupling, and aperture coupling. (A good classification of different feeding constructions is given in "A Review of Some Microstrip Antenna Characteristics" by Daniel H. Schaubert from "Microstrip Antennas: the analysis and design of microstrip antennas and arrays. A selected reprint volume," IEEE Press 1995.) Some of these feeding constructions use feed lines which have DC contact to the radiation element as well as other antenna elements, such as antenna element 21 (but different degrees of coupling at the receiving frequencies), and some of these constructions can have feed lines which are conductively isolated from the radiation element and other antenna elements. However, when all of these constructions are applied to the present invention, the receiving antenna element is considered to be "fed" while the passive antenna element is considered to be "un-fed," in the manner that these terms are known and used in the art of signal feeding. In other words, the degree of electrical coupling (e.g., signal feeding) between the receiving antenna element 11 and the signal port (and LNA or coax cable) is greater than the degree of electrical coupling between the passive antenna element 21 and the signal port (and LNA or coax cable), particularly at the receiving frequency (working frequency) of the receiving antenna and the band of frequencies around the receiving frequency (e.g., the bandwidth defined by VSWR≦2). This is in contrast to omni-directional antenna systems, wherein the degree of coupling (degree of feeding) is the same at all frequencies.

For the above types of feeding constructions, we generally define the signal port as the location where the radio-signals received from the receiving antenna element are made available for use, such as by an LNA or by a transmission cable. More generally, we define a signal port of an antenna system according to the present invention as a port which provides the radio-signals which the antenna system is constructed to preferentially receive or transmit. Below, we provide examples of antenna systems which are constructed to preferentially receive multiple frequencies, and such embodiments have more than one signal port, one for each preferentially-received frequency.

Figure 3:
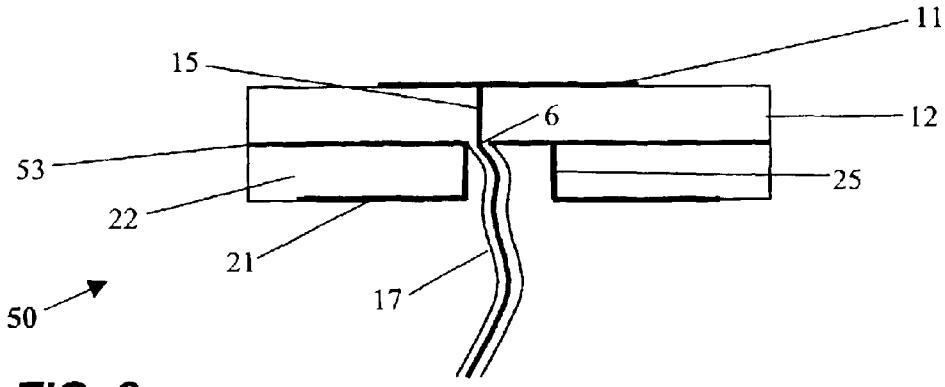
FIG. 3 is a cross-sectional view of a second exemplary embodiment of an antenna system according to the present invention.

In general, there is a frequency at which antenna element 11 has a peak input resistance value with respect to ground plane 13 at port 6 (embodiment of FIGS. 1 and 2), or with respect to ground plane 53 at signal port 6 (embodiment of FIG. 3). (The input resistance is the real part of the input impedance.) We refer to this frequency as the "receiving frequency," or "working frequency," of antenna element 11. The peak input resistance can be measured as a function of frequency with a number of instruments known to the art, such as a vector impedance meter, a network analyzer, etc. The value of the working frequency is mainly dependent upon the size and shape of antenna element 11, the size of any tuning elements attached to the element (examples of which are described below with respect to FIG. 6), and the dielectric constant and thickness of dielectric substrate 12. To a substantially lesser degree, the value of the working frequency is dependent upon the surface areas of ground plane 13 (or 53) and dielectric substrate 12, the size of aperture 14 (or 54), and the size and routing of lead 15.

In general, the reception and coupling of radio signals from antenna element 11 to signal port 6 is at or near a maximum at the receiving frequency. We note that a user may choose to operate the antenna at a frequency which is slightly different from the above-defined "receiving frequency" in order to meet other objectives besides maximum reception, or that a manufacturer may choose to construct his antenna to have a "receiving frequency" which is slightly different from the frequency that the antenna is advertised to operate at, also in order to meet other objectives. In such cases, the operating frequency is generally within the antenna's bandwidth (VSWR≦2).

Figure 6:
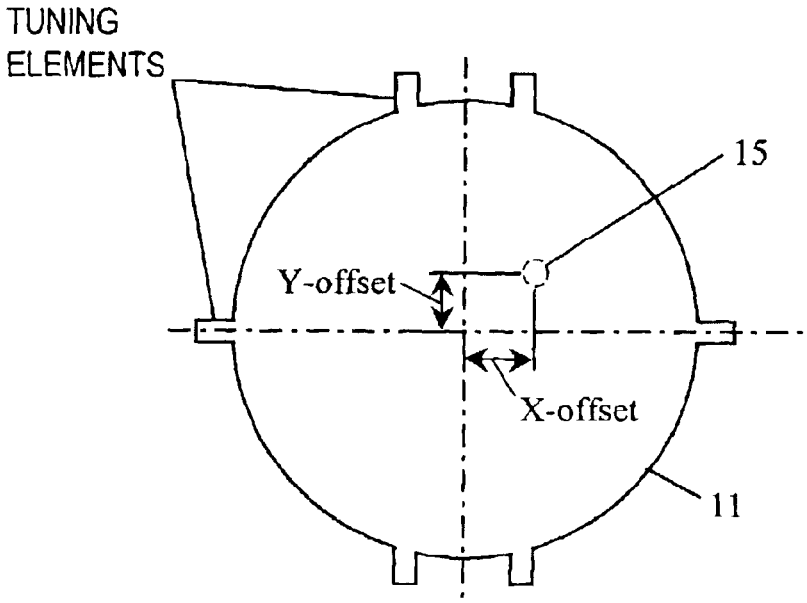
FIG. 6 shows a top plan view of the circular shaped antenna element with tuning elements according to the present invention.

In practice, one can use simulation software or conventional design formulas to formulate the rough dimensions for antenna element 11 for a working frequency which is slightly less than the desired working frequency. The antenna is constructed, and the working frequency is measured, such as by using any of the above-referenced equipment. Then, portions of antenna element 11 are gradually trimmed away to raise the working frequency to the desired value. Tabs may be preformed on the ends of antenna element 11 as tuning elements to facilitate the trimming process (examples of which are shown in FIG. 6). Instead of using software or design formulas, one can construct a matrix of test structures, each with different dimensions for element 11, to determine rough dimensions for element 11. Appendix A provides some basic information on the construction of rectangular patch antennas. The information therein can be used to formulate the rough dimensions of square, rectangular, and circular antenna elements for a desired resonant frequency or working frequency.

For global positioning applications, the working frequency of antenna element 11 is set to a value that is in, or close to, one or both of the L1-bands (1575.42 MHz±12 MHz for GPS, 1602.5625 MHz to 1615.5 MHz for GLONASS), or that is in, or close to, one or both of the L2-bands (1227.60 MHz±12 MHz for GPS, 1240 MHz to 1260 MHz for GLONASS).

Figure 4:
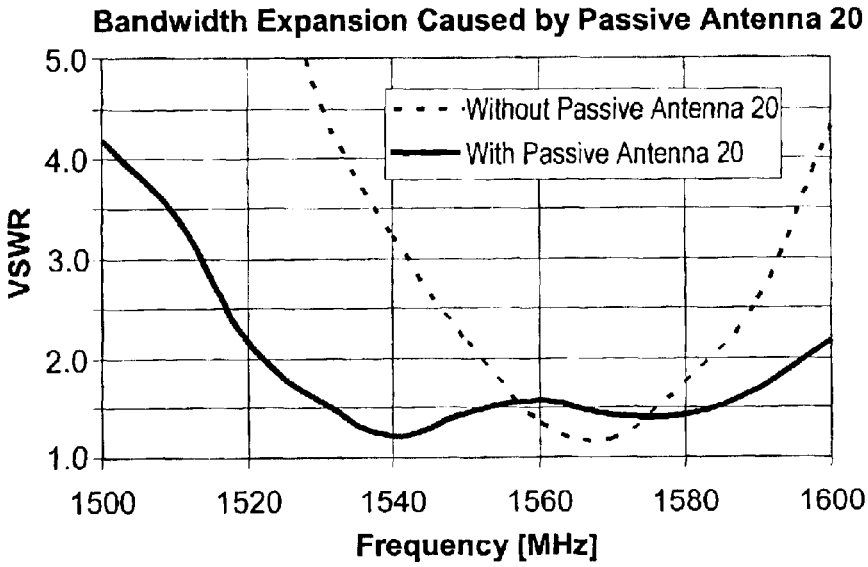
FIG. 4 is a graph of the voltage standing wave ratios (VSWRs) of a receiving antenna alone, and a combination of a receiving antenna and passive antenna according to the present invention.

The presence of passive antenna 20 can shift the working frequency of receiving antenna 10 by 2%–3%, and significantly broaden (more than double) the bandwidth of receiving antenna 10, the effect being an unexpected benefit for some GPS applications. FIG. 4 shows the voltage-standing-wave ratio (VSWR) of an exemplary receiving antenna that has a working frequency near 1568 MHz (GPS L1 band). The dotted line shows the VSWR without passive antenna 20, and the solid line shows the VSWR with the passive antenna 20. The minimum in the VSWR value closely correlates with the working frequency of receiving antenna 10. (The inductance of lead 15 causes a small difference between the working frequency and the frequency at which the VSWR is a minimum.) One conventional definition of antenna bandwidth is the range of frequencies in which the VSWR has a value of 2.0 or less. With this definition, the dotted line indicates that receiving antenna 11 by itself has a working frequency of around 1565 MHz and a bandwidth of about 30 MHz (bandwidth of 2%). When passive antenna 20 is positioned below receiving antenna 10, the working frequency moves to 1540 MHz and the bandwidth increases to about 70 MHz (bandwidth of about 4.8%). In addition, a secondary minimum appears around 1575 Hz, at the center of the GPS L1-band. In this example, passive antenna 20 has a resonant frequency of 1580 MHz. (The resonant frequency is defined below.)

The position of the feed lead 15 to antenna element 11 was chosen to provide appropriate impedance matching and enhanced reception of right-hand circular polarized signals. This offset technique is known to the microstrip art, and details for practicing it may be found in the book entitled "Microstrip Antenna Design Handbook" by Ramesh Garg, Prakash Bhartia, Inder Bahl, Apisak Ittipiboon, 2001, Artech House, Inc., see pages 317–394 in particular. It improves impedance matching, but it is not necessary for making, practicing, and using the present invention, particularly in its broadest applications and embodiments. The offset also improves reception of circularly polarized antenna signals when circularly shaped elements 11 are used with tuning elements, or when rectangular-shaped elements 11 are used. However, other configurations of antenna element 11 may be used to achieve improved reception of circularly polarized antenna signals (e.g., 2-point and 4-point feed configurations).

Figure 5:
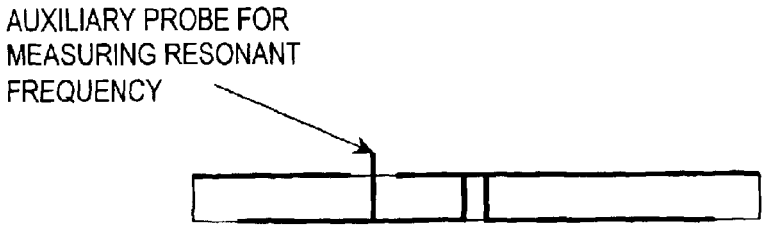
FIG. 5 shows a cross-sectional view of a configuration for measuring the resonant frequency of a passive antenna according to the present invention.

Passive antenna 20 is constructed such that its resonant frequency is close to the working frequency of receiving antenna 10. For the global positioning L1-band and L2-band, the resonant frequency of passive antenna 20 is preferably within −60 MHz to +25 MHz of the working frequency of receiving antenna 10 (−5% to +2% of center frequency). The resonant frequency of passive antenna 20 can be measured in the same way as it is was done for receiving antenna 10. To do this, an auxiliary probe is inserted into the passive antenna 20 (as shown in FIG. 5), and the input impedance as a function of excitation frequency is measured at the coax probe output. During these measurements, the receiving antenna must be removed or its impact on the resonant frequency will be unpredictable. The frequency at which the maximum in the real part of the input impedance occurs indicates the resonant frequency.

In preferred practice, the size of the passive antenna patch is finally tuned during minimization of the down/up ratio in the direction of zenith/anti-zenith (θ=90°). To do this, the frequency curve showing how the value of the down/up ratio in this direction changes with frequency is measured in an anechoic chamber. Initially, this frequency curve has a minimum value at some frequency. During the tuning process, by changing the size of the passive antenna patch, it is possible to shift the minimum of the down/up ratio to the desired frequency.

We now provide the dimensions for an exemplary embodiment of the present invention for the GPS L1 frequency band.

| Dimensions for Receiving Antenna 10: | |
|---|---|
| Thickness of the substrate 12 | 6.35 mm (0.250") |
| Dielectric constant of substrate 12 | 9.2 |
| Shape of the substrate 12 | Rectangular (square) |
| Size of the substrate 12 | 45 mm × 45 mm (1.77" × 1.77") |
| Size of the ground plane 13 | 45 mm × 45 mm (1.77" × 1.77") |
| Shape of antenna element 11 | circular, with tuning elements |
| Diameter of the main part of antenna element 11 | 30.5 mm (1.200") |
| Position of feed lead 15 | |
| X-offset from the center | 2 mm (0.080") |
| Y-offsct from the center | 2 mm (0.080") |
| Diameter of plated hole for feed 15 | 2.5 mm (0.098") |

FIG. 6 is a top plan view of the circular-shaped antenna element 11. The location of the tuning elements and the X- and Y-offsets of feed 15 are indicated in the figure. More tuning elements are provided along one axis than another, which provides an asymmetry for the reception of circularly-polarized signals. The distribution of tuning elements shown in FIG. 6 along with the offsets of feed 15 provide for the enhanced reception of right-hand circularly polarized signals. Trimming of the tuning elements enables the receiving frequency of antenna 10 to be increased, and the tuning elements are trimmed to provide final tuning of the antenna characteristics. The tuning elements used here and in other embodiments of the present invention may have a generally square shape of approximately 3 mm by 3 mm.

| The dimensions for passive antenna 20 are: | |
|---|---|
| Thickness of the substrate 22 | 6.35 mm (0.250") |
| Dielectric constant of substrate 22 | 9.2 |
| Shape of the substrate 22 | Rectangular (square) |
| Size of the substrate 22 | 45 mm × 45 mm (1.8" × 1.8") |
| Size of the ground plane 23 | 45 mm × 45 mm (1.8" × 1.8") |
| Shape of anterma element 21 | circular with tuning elements |
| Diameter of the antenna element 21 | 31.0 mm (1.220") |
| Position of through hole 25 | Center of element 21 |
| Diameter of through hole 25 | 5.80 mm (0.23") |

Figure 7:
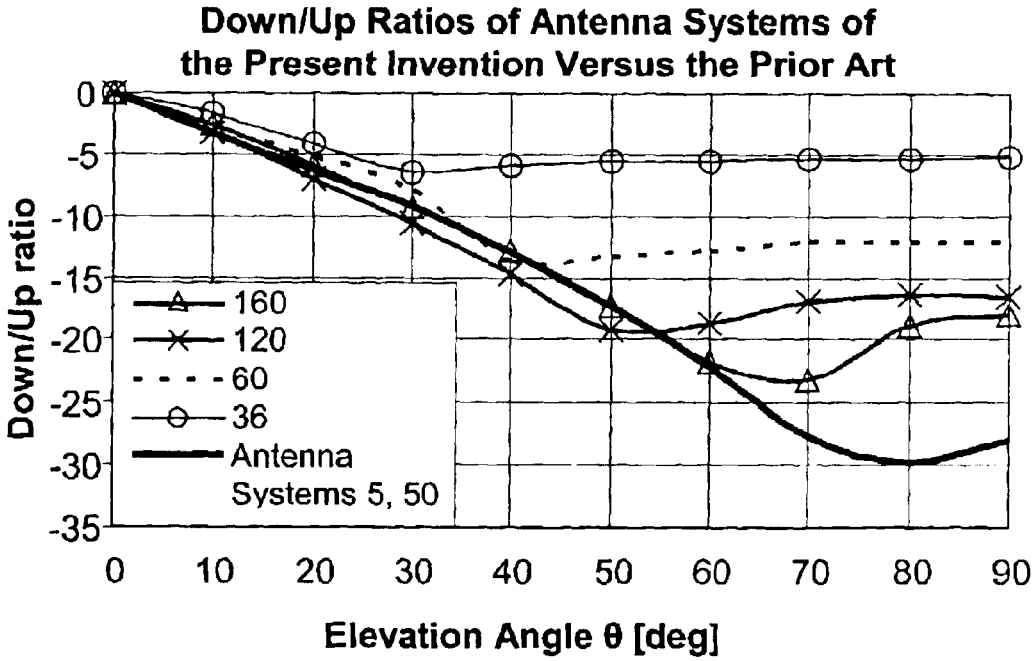
FIG. 7 is a graph comparing the down/up ratio performance of an exemplary embodiment according to the present invention to the performance of several conventional antennas.

FIG. 7 illustrates the multipath rejection capability of this exemplary embodiment by comparing its down/up ratio against the ratios of several conventional GPS L1-band antennas which have various sized ground planes. The down/up ratio was previously described above, and is more fully described in Appendix B. As indicated above, the down/up ratio is measured as a function of the elevation angle θ of the incoming satellite signal with respect to the plane of the antenna's ground plane (which is parallel to the horizontal plane at the target point when the antenna is placed in a plumb position, as described above). In general, a more negative number indicates better multipath rejection characteristics. As a result of its definition, the down/up ratio will be 0 dB for an elevation angle of zero degrees: θ=0. We are generally interested in the value of the ratio in the range of $20° \leqq \theta \leqq 90°$, and more particularly in the range of $40° \leqq \theta \leqq 90°$.

The working frequencies of the conventional antennas were about 1575 MHz. All the conventional antennas have the same antenna element (30 mm patch antenna), and the same dielectric thickness (6.35 mm) and dielectric constant (9.2), but had different ground plane diameters, as follows 36 mm, 60 mm, 120 mm, and 160 mm. The down/up ratios for these antennas are shown in FIG. 5 with the following curve notations: solid line with circle markers (36 mm diameter), dashed line (60 mm diameter), solid line with "X" markers (120 mm diameter), and solid line with triangle markers (160 mm). In general, the ratios improve as the diameter of the ground plane increases. However, for elevation angles between 200 and 530, the 120 mm ground plane provides 1 dB to 2.5 dB better performance than the 160 mm ground plane. However, the 160 mm ground plane provides 1 dB to 7 dB better performance for elevation angles between 53° and 90°.

The down/up ratio for the above exemplary antenna system according to the present invention is shown by the unmarked, solid line of FIG. 5. It generally matches the ratio for the 160 mm antenna for elevation angles between 0° and 60°, but does so with 1/10 of the ground plane area, 20.25 $cm^2$ versus 201 $cm^2$. This is a significant advantage since the antenna is 1/10 the size. As an additional benefit, the performance of the exemplary antenna system according to the present invention exceeds that of the 160 mm antenna by 1 dB to 12 dB for elevation angles between 60° and 90°. At 90° (zenith), the embodiment of the present invention has a down/up ratio better than −25 dB.

Figure 8:
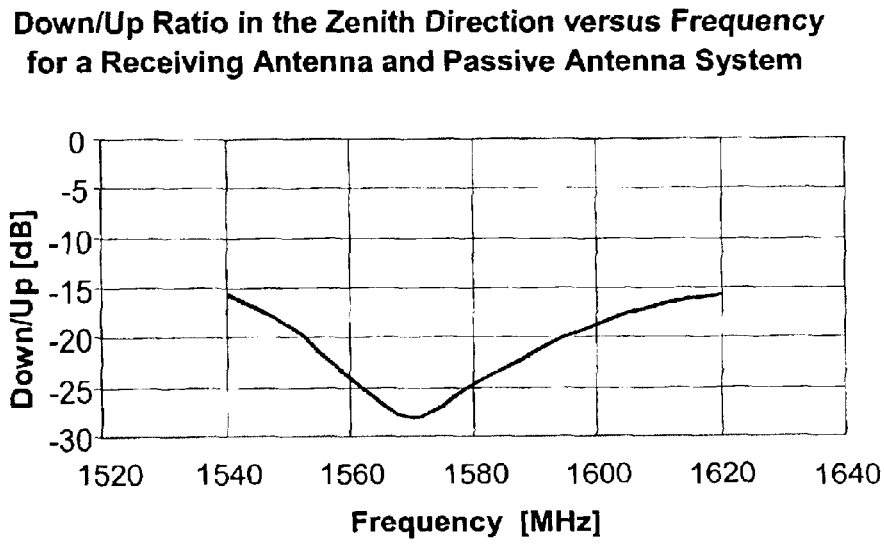
FIG. 8 is a graph of the down/up ratio as a function of signal frequency of an exemplary antenna system according to the present invention.

Since the passive antenna is an antenna structure, it has a resonance behavior with respect to the received frequency of electromagnetic radiation. This resonance behavior can make, and often does make, the down/up ratio a function of received frequency. This is shown in FIG. 8, where the down/up ratio is plotted as a function of signal frequency with the elevation angle at 90°. The down/up ratio at this elevation angle is referred to herein as the zenith down/up ratio. There is a minimum in the ratio around 1570 MHz, at a value of about 27.5 dB. The ratio increases (deteriorates) in value on either side of the minimum, and increases to a value of about −15 dB at the extremes of the frequency range that covers the GPS L1-band and GLONASS L1-band.

As a practical tuning method, the tuning elements on antenna element 11 of receiving antenna 10 are tuned to provide the receiving antenna with a desired working frequency, and the tuning elements on antenna element 21 of the passive antenna are trimmed to set the zenith down/up ratio, as measured at the elevation angle of 90°, to the largest negative value for the desired working frequency.

While we prefer to electrically couple receiving antenna element 11 to the signal port 6 by a conductive feed 15, it may be appreciated that the signals received by receiving antenna element 11 may be coupled to a signal port by other types of couplers, such as by a slot-line coupler or a capacitor coupler. In these cases, the signal port is the location where the radio-signals received from receiving antenna element 11 are made available for use, such as by an LNA or by a transmission cable. Such other types of couplers do not necessarily require a conductive coupling or conductive connection between the signal port and the antenna element. Nonetheless, the degree of electrical coupling between the receiving antenna element and the signal port is greater than the degree of electrical coupling between the passive antenna element and the signal port, particularly at the receiving frequency (working frequency) of the receiving antenna and the band of frequencies around the receiving frequency (e.g., the bandwidth defined by VSWR≦2). That is, in contrast to omni-directional antenna systems, the receiving antenna element and the passive antenna element have unequal degrees of electrical coupling to the signal port which provides the signal output (or input) of the antenna system. The statements of this paragraph are applicable to all of the embodiments of the present invention, including those described below.

Dual Frequency Embodiments.

The down/up ratio for system 5 is not as good in one GPS frequency band (e.g., the L2-band) as the other (e.g., the L1-band). Improved performance in both bands may be addressed by a construction of antenna systems which include one of the following configurations:

(1) two receiving antennas, the combination of which covers receiving frequencies in the L1 and L2 bands, and one passive antenna element having a resonant frequency in one of the bands or between the two bands;

(2) one receiving antenna having a working frequency in one of the bands or between the two bands, and two passive antennas with resonant frequencies near the bands or between the bands;

(3) two receiving antennas, the combination of which covers receiving frequencies in the L1 and L2 bands, and two passive antennas with resonant frequencies near the bands or between the bands.

We describe an example of the third construction. From this description and the other information provided herein, one of ordinary skill in the art can construct embodiments of the first and second constructions.

Figure 9:
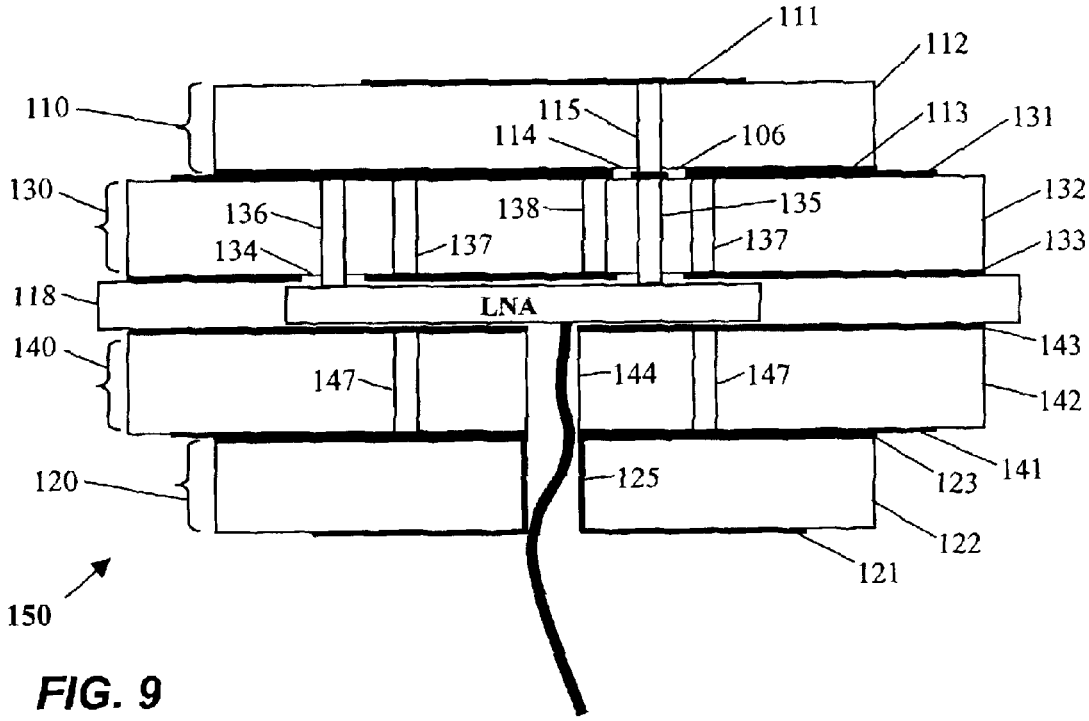
FIG. 9 is a cross-sectional view of a dual frequency antenna system according to the present invention.
Figure 10:
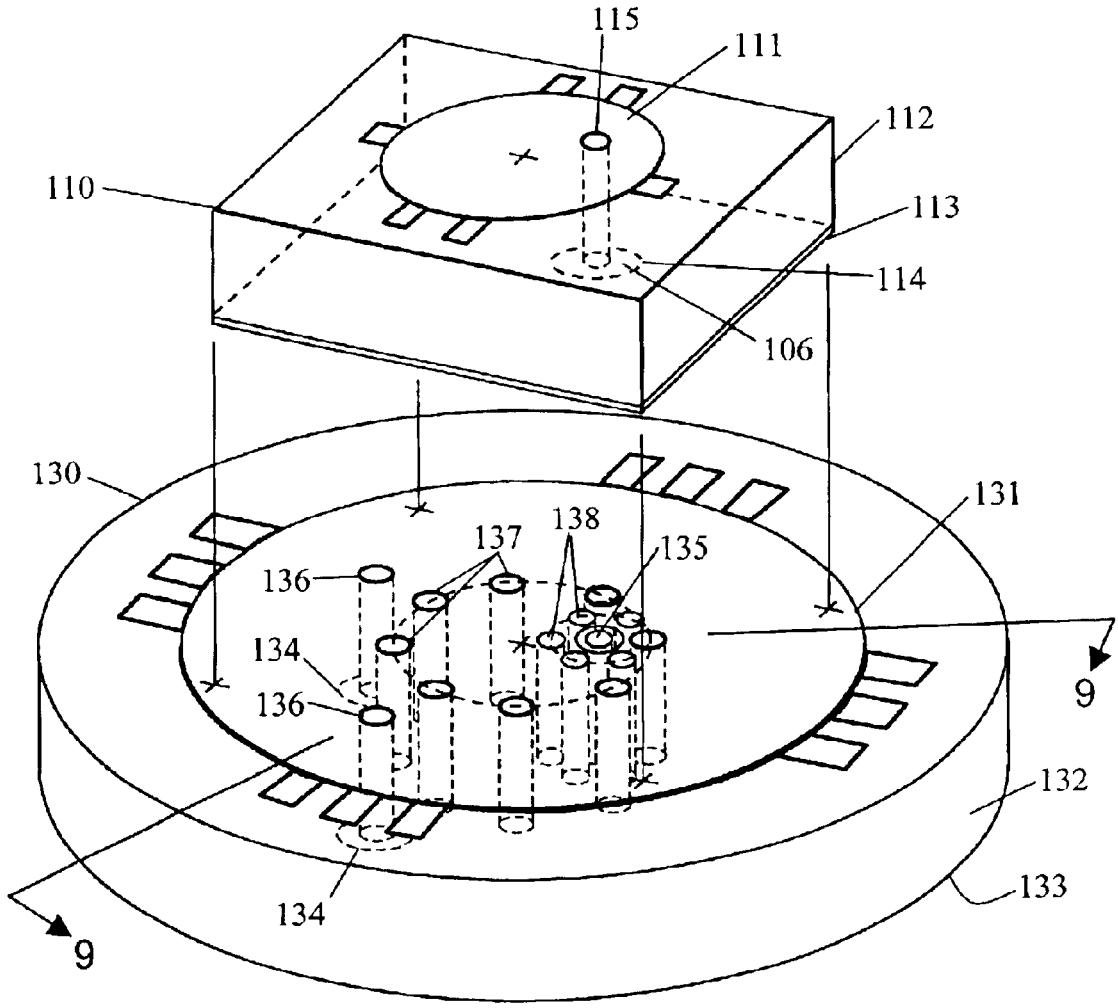
FIG. 10 is an expanded perspective view of the assembly of the receiving antennas of the exemplary system shown in FIG. 9 according to the present invention.
Figure 11:
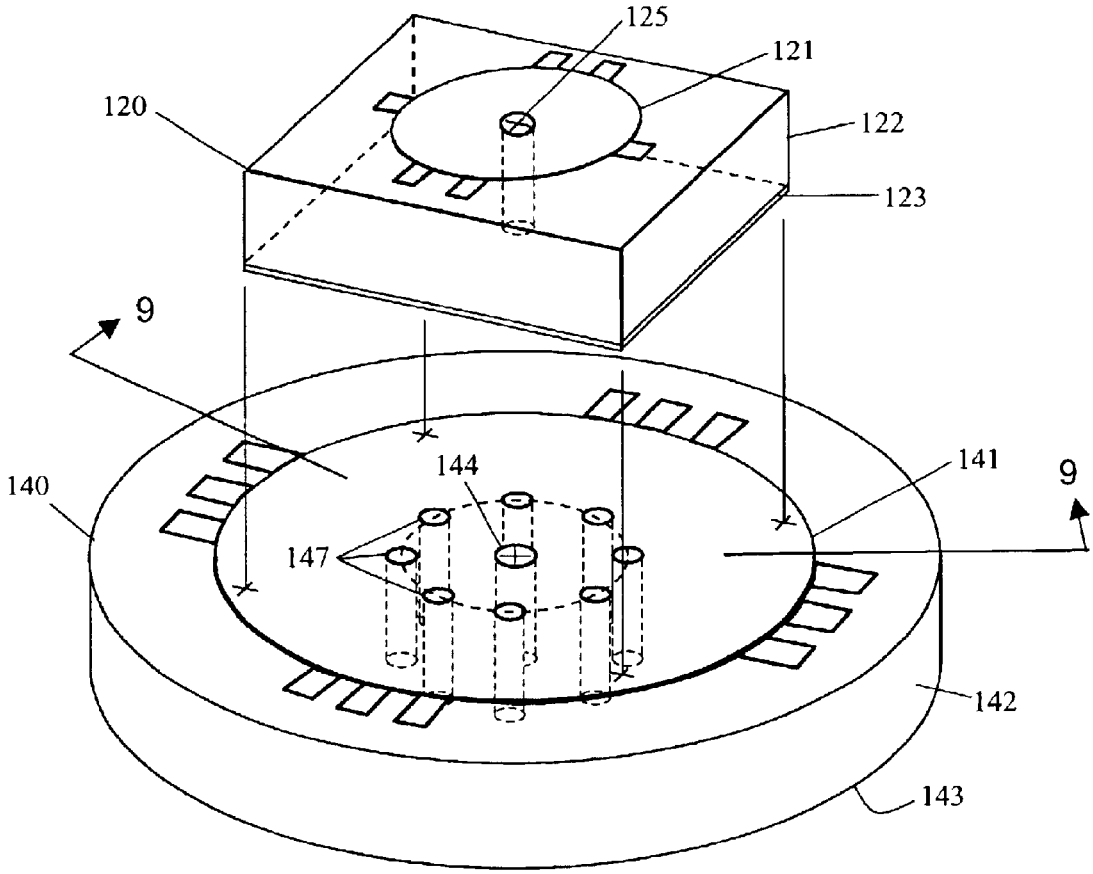
FIG. 11 is an expanded perspective view of the assembly of the passive antennas of the exemplary system shown in FIG. 9 according to the present invention.

With reference to FIGS. 9–11, we next describe an antenna system 150 of the present invention which comprises two receiving antennas 110 and 130, two passive antennas 120 and 140, and a grounded enclosure 118. FIG. 9 shows a cross sectional view of antenna system 150, FIG. 10 shows an exploded perspective view of the assembly of receiving antennas 110 and 130, and FIG. 11 shows an exploded perspective view of the assembly of passive antennas 120 and 140. Receiving antenna 110 is constructed to receive signals in an L1-band (GPS, GLONASS, or both), and receiving antenna 130 is constructed to receive signals in an L2-band (GPS, GLONASS, or both). Passive antenna 120 is constructed to have a resonant frequency in or near the L1 band of antenna 110, and passive antenna 130 is constructed to have a resonant frequency in or near the L2 band of antenna 120. Grounded enclosure 118 may be constructed in the same ways as grounded enclosure 18 described above.

Receiving antenna 110 has a construction similar to that of receiving antenna 10 (shown in FIGS. 1–2). With reference to FIGS. 9 and 10, receiving antenna 110 comprises a dielectric substrate 112 having a first surface and a second surface, an antenna element 111 disposed on at least a portion of the first surface of substrate 112, and a conductive ground plane 113 disposed on the second surface of substrate 112. Antenna element 111 and ground plane 113 collectively comprise a conventional patch antenna configuration. In general, ground plane 113 extends over the same amount of area or more as antenna element 111, and covers a portion or all of the second surface of dielectric substrate 112. However, it is possible for ground plane 113 to cover a lesser amount of area than antenna element 111. Receiving antenna 110 further comprises a conductive feed lead 115 formed from antenna element 111 through dielectric substrate 112 and extending to at least the second surface of substrate 112. Feed 115 may extend out past the second surface of substrate 112. An aperture 114 is formed in ground plane 113 to conductively isolate feed lead 115 and ground plane 113 (i.e., to prevent a direct current path between lead 115 and plane 113). Aperture 114 is preferably located concentrically about lead 115 to form a coaxial interface and a signal port 106.

Feed 115 is offset to provide for enhanced reception of RHCP signals. Two-point and four-point feed arrangements can also be used.

Receiving antenna 130 comprises a dielectric substrate 132 having a first surface and a second surface, an antenna element 131 disposed on at least a portion of the first surface of substrate 132, and a conductive ground plane 133 disposed on the second surface of substrate 132. Antenna element 131 and ground plane 133 collectively comprise a conventional patch antenna configuration. In general, ground plane 133 extends over the same amount of area or more as antenna element 131, and may cover a portion or all of the second surface of dielectric substrate 132. However, it is possible for ground plane 133 to cover a lesser amount of area than antenna element 131. Receiving antenna 130 further comprises two conductive feed leads 136, each extending from antenna element 131 through dielectric substrate 132 to at least the second surface of substrate 132. Each feed 136 may extend out past the second surface of substrate 132. An aperture 134 is formed in ground plane 133 around each feed lead 136 to conductively isolate it from ground plane 133 (i.e., to prevent a direct current path between lead 136 and plane 133). Aperture 134 is preferably located concentrically about lead 136 to form a coaxial interface and a signal port.

One of leads 136 is shown in FIG. 9, and both are shown in FIG. 10. Antenna element 131 comprises a main circular shape. Feed leads 136 are offset from the center of antenna element 131, and are separated by a 90°-angle sector of the main circular shape of element 131. Feed leads 136 may be combined by a conventional 3-dB hybrid coupler housed within the LNA inside grounded enclosure 118. This configuration enhances the reception of circularly polarized signals. As is known in the art, two inputs of the hybrid coupler are phase shifted by 90°, and the way in which the two feed leads 136 are coupled to the two inputs of the hybrid coupler determines whether right-hand circularly polarized or left-hand circularly polarized signals are preferentially received by the antenna. In this case, the couplings are made to select right-hand circularly polarized signals for preferential reception.

Receiving antenna 130 further comprises a first plurality of grounding leads 137 which couples the ground plane 133 to receiving antenna 131. Grounding leads 137 are distributed around a circle which is concentric about the center of antenna element 131, and to the inside of feed leads 136 (in other words, at a shorter radial distance from the center of antenna element 131). The circle is shown with a dashed line. Eight grounding leads 137 are used. They provide the possibility of separate functioning of antenna elements 110 and 130. If they were absent, the feed unit of element 110 comprising grounding leads 138 and feed lead 135 would have an impact on the operation of antenna element 130. Receiving antenna 130 further comprises a feed lead 135 for coupling feed lead 115 of antenna 110 to the LNA (or coaxial line) within grounded enclosure 118. As an alternate approach, a through-hole aperture may replace lead 135, and lead 115 may comprise a long pin or wire which passes through this aperture to connect with the LNA. Receiving antenna 130 further comprises a second plurality of grounding leads 138 coupled between ground plane 133 and receiving antenna 131. Grounding leads 138 are located within the shielded space provided by grounding leads 137, and are distributed around a circle which is concentric about feed lead 135. The circle is shown with a dashed line. Five grounding leads 138 are used. They provide impedance matching to antenna element 110 by forming together with feed lead 135 a short piece of a coax cable with appropriate wave impedance. That is, grounding leads 138 form an outer conductor of said coax cable and feed lead 135 is an inner coax conductor. The radius of the circle where the grounding leads are located, their own radiuses and the radius of feed lead 135 define the wave impedance of the coax.

Ground plane 113 of receiving antenna 110 is soldered or otherwise conductively bonded to receiving element 131 of receiving antenna 130. The bonding may occur over the entire surface of ground plane 113, or along the edges of ground plane 113, or at a pattern of spots located on ground plane 113. The ground plane 131 of receiving antenna 130 may be coupled to conductive enclosure 118 in any of the ways described above for the coupling of ground plane 13 to grounded enclosure 18.

Passive antenna 120 has a construction similar to that of passive antenna 20 (shown in FIGS. 1–2). With reference to FIGS. 9 and 11, passive antenna 120 comprises a dielectric substrate 122 having a first surface and a second surface, an antenna element 121 disposed on at least a portion of the first surface of substrate 122, and a conductive ground plane 123 disposed on the second surface of substrate 122. Antenna element 121 and ground plane 123 collectively comprise a conventional patch antenna configuration. In general, ground plane 123 extends over the same amount of area or more as antenna element 121, and covers a portion or all of the second surface of dielectric substrate 122. However, it is possible for ground plane 123 to cover a lesser amount of area than antenna element 121. Passive antenna 120 further comprises a through-hole 125 formed through dielectric substrate 122 from antenna element 121 to grounding plane 123. Like the through-hole of the previous embodiments, through-hole 125 is provided to enable a cable to be routed from grounded enclosure 118 to the outside environment. In general, through-hole 125 is plated with conductive material and forms a conductive path between the center of antenna element 121 and ground plane 123. The plated conductive material minimizes the impact that the cable would have on the operation of passive antenna 120. However, if the cross-sectional area of through-hole 125 is 15 to 20 times smaller than the area of antenna element 121, then the inner surfaces of through-hole 125 can be un-plated since such a small cross-sectional area will have little effect on the operation of the passive antenna. As another implementation, through-hole 25 may comprise a plurality of smaller plated through-holes disposed in a circle which is concentric with the center of antenna element 121. A separate through-hole may be provided at the center of antenna element 121 to allow a coax cable and/or other cabling to exit from grounded enclosure 118.

Passive antenna 140 comprises a dielectric substrate 142 having a first surface and a second surface, an antenna element 141 disposed on at least a portion of the first surface of substrate 142, and a conductive ground plane 143 disposed on the second surface of substrate 142. Antenna element 141 and ground plane 143 collectively comprise a conventional patch antenna configuration. In general, ground plane 143 extends over the same amount of area or more as antenna element 141, and covers a portion or all of the second surface of dielectric substrate 142. However, it is possible for ground plane 143 to cover a lesser amount of area than antenna element 141. Passive antenna 140 further comprises a through-hole 144 formed through dielectric substrate 142, and aligned with through-hole 125 of passive antenna 120. Through-holes 144 and 125 are provided to enable a cable to be routed from grounded enclosure 118 to the outside environment. Through-hole 144 does not have to be plated with conductive material, but can be. Like receiving antenna 130, passive antenna 140 comprises a plurality of grounding leads 147 which couple ground plane 143 to receiving antenna 141. Grounding leads 147 are distributed around a circle which is concentric about the center of antenna element 141. The circle is shown with a dashed line. Eight grounding leads 147 are used. They substantially follow the same pattern as grounding leads 137 in receiving antenna 130. However, this is not necessary, but it does make the construction of passive antenna 140 similar to that of receiving antenna 130, and thereby simplifies manufacturing.

Ground plane 123 of passive antenna 120 is soldered or otherwise conductively bonded to receiving element 141 of passive antenna 140. The bonding may occur over the entire surface of ground plane 123, or along the edges of ground plane 123, or at a pattern of spots located on ground plane 123. The ground plane 141 of receiving antenna 140 may be coupled to conductive enclosure 118 in any of the ways described above for the coupling of ground plane 23 to grounded enclosure 18.

The geometry and parameters of the high-frequency antennas 110 and 120 are selected as in the case of the single frequency embodiment. Tuning elements, generally of the size of 3 mm by 3 mm, are added to elements 111 and 121 to enable tuning of the working and resonant frequencies. For the low-frequency antennas 130 and 140, the substrates 112 and 122 of the high-frequency antennas 110 and 120 affect the effective dielectric constants seen by the low-frequency antenna elements 131 and 141. In general, elements 131 and 141 are reduced in size compared to the case where they are used alone in a single frequency (L2 band)

antenna system. A good approach to selecting the geometry and parameters of low-frequency antennas 130 and 140 is to simulate several different designs (which include the high-frequency antennas) with a computer simulation program which implements full three-dimensional electromagnetic wave analysis, and then select designs that provide the desired working and resonant frequencies for the low-frequency antennas. Generally, one starts with a design suitable for a single-frequency antenna system, and then scales down the dimensions in several steps, and simulates the performance of each scaled version. Several simulation programs are commercially available to accomplish this (e.g., the WIPL-D simulation program from the WIPL-D software corporation). In place of the software simulations, one may construct several scaled versions and measure the resulting frequencies. As with the high-frequency antennas 110 and 120, tuning elements are included on elements 131 and 141 to enable the frequencies to be tuned to desired values by trimming off sections of the elements.

While the use of an LNA within enclosure 118 is preferred, it may be omitted for some embodiments. In this case, enclosure 118 provides room for coaxial lines and/or signal combiners to be routed to feed leads 135 and 136. Also, if an LNA 16 is not used, enclosure 118 may be replaced by a multi-layer circuit board which provides the routing, and which electrically couples the antenna ground planes 133 and 143 together. A 3-dB hybrid coupler for feed leads 136 may be formed within such a multi-layer circuit board.

We now provide the dimensions for an exemplary dual-frequency embodiment of the present invention for a L1-band and L2-band antenna system that receives both GPS and GLONASS satellites.

| Dimensions for Receiving Antenna 110 (GPS/GLONASS L1-bands): | |
|---|---|
| Thickness of the substrate 112 | 6.35 mm (0.250") |
| Dielectric constant of substrate 112 | 9.2 |
| Shape of the substrate 112 | Rectangular (square) |
| Size of the substrate 112 | 45.2 × 45.2 mm (1.780") |
| Shape of the ground plane 113 | circular |
| Diameter of the ground plane 113 | 40.6 mm (1.600") |
| Shape of antenna element 111 | circular, with tuning elements |
| Diameter of the central part of antenna element 111 | 30.5 mm (1.200") |
| Position of center of feed lead 115 | |
| X-offset from the center | 1.9 mm (0.075") |
| Y-offset from the center | 2.2 mm (0.085") |
| Diameter of plated hole for feed 115 | 2.1 mm (0.084") |

| Dimensions for Receiving Antenna 130 (GPS/GLONASS L2-bands): | |
|---|---|
| Thickness of the substrate 132 | 5.08 mm (0.200") |
| Dielectric constant of substrate 132 | 6.0 |
| Shape of the substrate 132 | Circular |
| Diameter of the substrate 132 | 73 mm (2.870") |
| Diameter of ground plane 133 | 73 mm (2.870") |
| Shape of antenna element 131 | circular, with tuning elements |
| Diameter of the circular part of antenna element 131 | 45.2 mm (1.780") |
| Distance of the center of feed lead 136 to the center of element 131 | 10.9 mm (0.430") |
| Diameter of feed leads 136 | 1.52 mm (0.060") |
| Diameter of circle on which the centers of grounding leads 137 are located | 11.2 mm (0.440") |
| Diameter of grounding leads 137 | 1.52 mm (0.060") |

-continued

| Dimensions for Receiving Antenna 130 (GPS/GLONASS L2-bands): | |
|---|---|
| Diameter of circle on which the centers of grounding leads 138 are located | 5.08 mm (0.200") |
| Diameter of grounding leads 138 | 1.27 mm (0.050") |

| The dimensions for passive antenna 120 (GPS/GLONASS Li-bands) are: | |
|---|---|
| Thickness of the substrate 122 | 6.35 mm (0.250") |
| Dielectric constant of substrate 122 | 9.2 |
| Shape of the substrate 122 | Rectangular (square) |
| Size of the substrate 122 | 45.2 × 45.2 mm (1.780") |
| Shape of the ground plane 123 | circular |
| Diameter of the ground plane 123 | 40.6 mm (1.600") |
| Shape of antenna element 121 | circular with tuning elements |
| Diameter of the antenna element 121 | 32.8 mm (1.290") |
| Position of through-hole 125 | Center of element 121 |

Through-hole 125 comprises 8 plated holes which are disposed on a circle with diameter of 10 mm (0.400"). These plated holes are substantially uniformly spaced, and each has a diameter of 1.52 mm (0.060").

| Dimensions for Passive Antenna 140 (GPS/GLONASS L2-bands): | |
|---|---|
| Thickness of the substrate 142 | 5.08 mm (0.200") |
| Dielectric constant of substrate 142 | 6.0 |
| Shape of the substrate 142 | Circular |
| Diameter of the substrate 142 | 70.6 mm (2.780") |
| Diameter of ground plane 143 | 70.6 mm (2.780") |
| Shape of antenna element 141 | circular, with tuning elements |
| Diameter of the circular part of antenna element 141 | 45.2 mm (1.780") |
| Diameter of circle on which the centers of grounding leads 147 are located | 11.2 mm (0.440") |
| Diameter of grounding leads 147 | 1.52 mm (0.060") |

The distance between ground planes 133 and 143, that is the thickness of enclosure 118, is about 17 mm (0.670"). The ends of feed leads 136 of the L2-band antenna 130 are grounded, and there are tap points on feed leads 136 where antenna signals are routed to the LNA. The distance between each tap point and a grounding point is approximately 5 mm (with an electrical length of approximately 0.05 of the wavelength of the frequency of 1230 MHz). While this presents a DC current path to the input of the LNA (or coax cable), it does not present an electrical ground to the LNA (or coax cable) at the receiving frequency of the antenna. This type of construction has the benefit of adjusting the level of input impedance seen at the tap point by selecting the distance from the tap point to the grounding end of feed lead 136. And while the grounding of feed lead 136 creates a DC current path between receiving antenna element 131 and passive antenna elements 121 and 141, antenna element 131 has a higher degree of signal feeding (electrical coupling) to the input of the LNA (or coax cable) than the passive antenna elements because of the location of the tap point.

The above parameters for receiving antenna 110 and passive antenna 120 are selected to provide the desired down/up performance in the L1 band, and the above parameters for receiving antenna 130 and passive antenna 140 are selected to provide the desired down/up performance in the L2 band. For receiving GPS and GLONASS signals in both the L1 and L2 bands, the tuning elements are trimmed to provide L1-band reception (VSWR≦2.0) by receiving antenna 110 in the frequency range of 1563 MHz to 1616 MHz, and L2-band reception (VSWR≦2.0) by receiving antenna 130 in the frequency range of 1216 MHz to 1260 MHz. For this, the resonant frequency of L1 passive antenna 120 is preferably tuned to be close (−60 MHz to +25 MHz) to the central frequency of L1 band (~1590 MHz), and the resonant frequency of L2 passive antenna 140 is preferably tuned to be close (−50 MHz to +20 MHz) to the central frequency of the above L2 band (~1240 MHz). As one example, one may take an iterative tuning process whereby:

1. Receiving antenna 110 is tuned to bring its working frequency to within 2% of the desired value in the L1-band, and passive antenna 120 is tuned to bring the frequency at which the minimum in the zenith down/up ratio (L1-band) to within 2% of that desired frequency value (which is typically at or close to the desired working frequency of antenna 110);
2. Then, receiving antenna 130 is tuned to bring its working frequency to within 2% of the desired value in the L2-band, and passive antenna 140 is tuned to bring the frequency at which the minimum in the zenith down/up ratio (L2-band) to within 2% of that desired frequency value (which is typically at or close to the desired working frequency of antenna 130);
3. Step (1) above is performed again to bring the frequency values closer to their target values, such as to within 1%;
4. Step (2) above is performed again to bring the frequency values closer to their target values, such as to within 1%;
5. Step (1) above is performed again to bring the frequency values to within desired tolerances of their target values, such as to within 0.5%; and
6. Step (2) above is performed again to bring the frequency values to within desired tolerances of their target values, such as to within 0.5%

The tuning elements may be trimmed according to methods described above to provide the desire performance in each band.

A further field of application of the present invention is in Wide Area Augmentation Systems (WAAS), such as Omnistar, Rascal and Satloc. In these systems, INMARSAT satellites are used to transmit differential corrections to users of GPS signals (e.g., users of GPS receivers). These differential corrections are transmitted on frequencies near 1530 MHz, which is close to GPS L1 band (1575.4±10.2 MHz). The extended bandwidth provided by the present invention enables a single antenna element to receive both the GPS L1-band signals and the differential correction signals.

The INMARSAT satellites are geostationary, so when a user is situated far from the Equator he sees the signals from these satellites at low elevations. For example, for a user at latitude of 550 and an altitude of 150 meters, a geostationary satellite can be seen at the elevation of 20°. In this case, in order to achieve high-quality reception of the differential correction signals, the antenna system must provide sufficiently high gain for the low elevation angle. To increase the antenna gain for low elevations, the ground plane of a microstrip antenna must be made smaller. However, such reduction increases the reception of multipath signals. The present invention solves this dilemma by providing good multipath rejection in the GPS L1-band while enabling the use of a small ground plane. Furthermore, as it was shown in FIG. 8, the multipath cancellation effect of the present invention can be made to be narrow-banded so that the passive antenna does not significantly reduce the reception of the INMARSAT satellite signals. Specifically, the passive antenna does not resonate well outside of the L1-band, and the antenna gain pattern of the receiving pattern is approximately the same as for a microstrip antenna with a small ground plane. Such an antenna has comparatively high gain for low elevation angles. This allows antenna systems according to the present invention to be used as combined GPS/INMARSAT antennas for WAAS applications.

Figure 12:
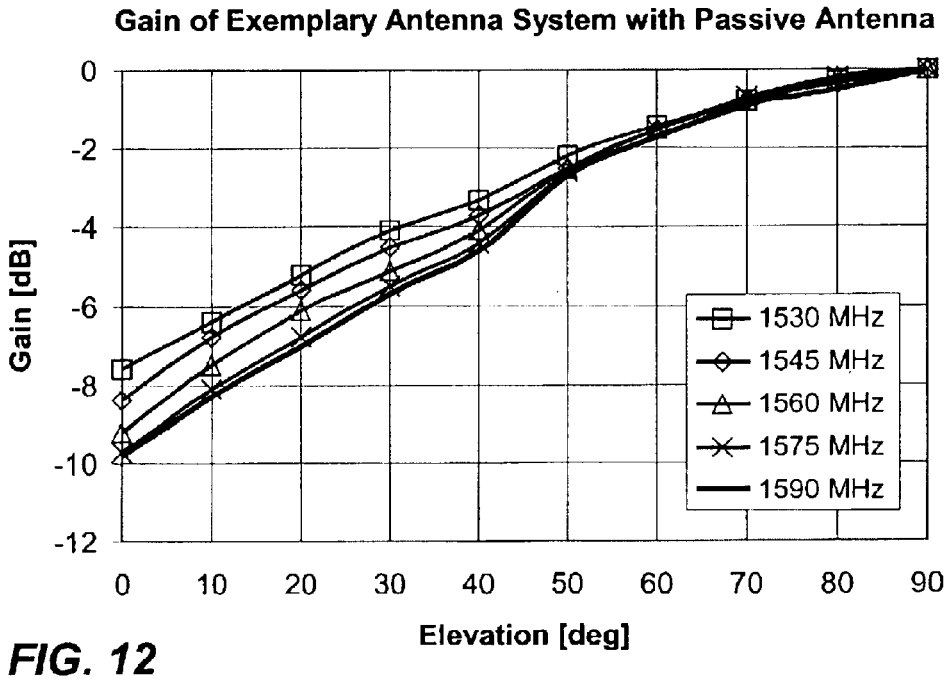
FIG. 12 shows a set of five antenna gain patterns of an exemplary L1-band antenna system according to the present invention.

FIG. 12 shows a set of five antenna gain patterns of an exemplary L1-band antenna system according to the present invention for the five corresponding frequencies 1530 MHz, 1545 MHz, 1560 MHz, 1575 MHz, and 1590 MHz. Each pattern plots antenna gain as a function of elevation angle. At the L1-band center frequency of 1575 MHz, the difference between the gains at the zenith elevation (θ=90°) and the horizon elevation (θ=90°) is about 10 dB. At the INMARSAT frequency of 1530 MHz, the difference between these gains is about 7.5 dB, roughly 2.5 dB better. The gain difference is the largest at GPS frequency band, where the passive antenna provides the best multipath rejection performance. In the INMARSAT band, the sensitivity to low elevation signals is better.

Another difficulty of using a GPS antenna to receive the INMARSAT satellite signals is the narrow bandwidth of conventional microstrip antennas. However, as we pointed out in FIG. 4, the passive antenna enables the patch antennas used in systems of the present invention to have increased bandwidths.

We provide here the geometry and parameters of an exemplary antenna system according to the present invention for receiving GPS/GLONASS L1-band signals and OMNISTAR signals:

| L1 Receiving Antenna: | |
|---|---|
| Thickness of the substrate | 6.35 mm (0.250") |
| Dielectric constant | 4.5 |
| Patch shape | Circular, with tuning elements |
| Diameter of the circular part of the patch | 45.2 mm (1.780") |
| RHCP preferential reception provided by two feed leads coupled to a 3-dB Hybrid coupler. | |
| Distance of the center of each feed point to the center of the patch antenna element | 8.1 mm (0.320") |
| Shape of the substrate | Circular |
| Diameter of the substrate | 72.8 mm (2.866") |
| Diameter of the ground plane | 72.8 mm (2.866") |

| L1 Passive antenna: | |
|---|---|
| Thickness of the substrate | 12.7 mm (0.500") |
| Dielectric constant | 4.5 |
| Shape of the substrate | Circular |
| Diameter of the substrate | 70.6 mm (2.780") |
| Diameter of the circular part of the patch | 41.4 mm (1.630") |

Eight plated holes (grounding feeds) with diameter of 0.060" (1.5 mm) form a circle in the center of L1 passive antenna with diameter 0,440" (11.2 mm).

The distance between ground planes of the L2 antenna and the L2 passive antenna is about 17 mm (0.670").

Features of Exemplary Embodiments of the Present Invention

The above exemplary embodiments provide very low zenith down/up ratios of generally equal to or less than −20 dB, and more typically equal to or less than −25 dB, at the working frequency f, while using ground planes that have areas that are equal to or less than $\lambda^2/4$ where λ is free-space wavelength of the working frequency f of the antenna, and more typically less than or equal to $\lambda^2/8$, and less than or equal to $\lambda^2/12$. In addition, the ratio of the area of the ground plane to the area of the antenna element is generally less than 3.5, and more typically less than 3.0, and 2.5 and 2.0. In some cases, the ratio of these areas may be less than 1.5. The widest dimensions of the ground planes (e.g., diameters of circular ground planes and diagonals of rectangular ground planes) can be equal to or less than 80 mm, and generally less than or equal to 65 mm for GPS and GLONASS applications. In addition, antenna bandwidths of 3% or more, and 4% or more with patch receiving elements may be achieved with the present invention (bandwidth being defined by VSWR of 2 or less).

In preferred embodiments of the present invention, the resonant frequency of a passive antenna is within −60 MHz to +25 MHz of the receiving frequency of the corresponding receiving antenna. Also in preferred embodiments, the frequency at which the zenith down/up ratio is a minimum (greatest negative value) is within 40 MHz to +25 MHz (−3.5% to +2%) of the working frequency of the antenna element. Typically, this frequency is lower in embodiments which are constructed for enhanced reception of the OMNISTAR correction signals than in embodiments which are only concerned with receiving the GPS/GLONASS signals.

Generalized Embodiments of the Present Invention.

While patch antenna elements have been used to illustrate embodiments of the active and passive antennas, it may be appreciated that other microstrip antenna elements may be used (e.g., crossed dipole). It may also be appreciated that other types of antennas besides microstrip based antennas may be used for the receiving antennas and passive antennas. The present invention also encompasses embodiments where microstrip passive antennas are used with non-microstrip receiving antennas, such as helix antennas. These embodiments and the embodiments described above achieve down/up ratios which are better than those where the receiving antennas are used alone, and are generally better (lower) than −10 dB, and often better (lower) than −20 dB.

While the present invention has been particularly described with respect to the illustrated embodiments, it will be appreciated that various alterations, modifications and adaptations may be made based on the present disclosure, and are intended to be within the scope of the present invention. While the invention has been described in connection with what are presently considered to be the most practical and preferred embodiments, it is to be understood that the present invention is not limited to the disclosed embodiments but, on the contrary, is intended to cover various modifications and equivalent arrangements included within the scope of the appended claims.

Appendix A: Approximate Dimensions of a Rectangular Patch Antenna

The resonant frequency of a rectangular patch antenna, $f_{res}$, can be selected by selecting the effective length $L_{eff}$ of the longest side of the antenna element. The effective length $L_{eff}$ is slightly larger than the actual side length L of the longest side, and the increased amount of $L_{eff}$ accounts for the fringing electric fields at the far ends (i.e., distal ends) of the antenna element. As is well known in the art, the resonant frequency $f_{res}$ has a corresponding free-space wavelength $\lambda_{res}$:$\lambda_{res}=c/f_{res}$ where c is the speed of light. For a given value of $f_{res}$, the effective length $L_{eff}$ is usually selected to be equal to the quantity:

$$L_{eff} = \frac{1}{2} \cdot \frac{\lambda_{res}}{\sqrt{\varepsilon_{r,eff}}}, \quad \text{[A1]}$$

where $\epsilon_{r,eff}$ is the effective relative dielectric constant of the supporting substrate as seen by the antenna element. The effective relative dielectric constant for the antenna element is generally approximated by the following formula that is known to the art:

$$\epsilon_{r,eff} = 1 + 0.63 \cdot (\epsilon_r - 1) \cdot \left(\frac{W}{d_S}\right)^{0.1255} \quad \text{for } W > d_S, \quad \text{[A2]}$$

where $\epsilon_r$ is the effective relative dielectric constant of the material forming the substrate, where W is the width of the more narrow side of the antenna element, where $d_S$ is the thickness of the substrate, and where the formula is applicable for the case of $W>d_S$. For the embodiments we are considering, the width W will be much greater than the thickness $d_S$.

From $\epsilon_{r,eff}$ and $\lambda_{res}$, the effective length $L_{eff}$ of a patch antenna can be estimated from the above equations [A1] and [A2].

We now estimate the extent of the fringing fields in order to estimate the actual length L of the patch antenna from $L_{eff}$. The customary approach in the art for accounting for the fringing fields is to assume that the fringing fields extend a distance of one-half the substrate thickness, that is $0.5 \cdot d_S$, at each distal end (i.e., far end) of the antenna's length, which makes: $L_{eff} \approx L + d_S$, which is equivalent to: $L \approx L_{eff} - d_S$. The true effective extent and effect of the fringing fields can be better estimated by simulation with a 3-d electromagnetic simulator.

Increasing L decreases the resonant frequency $f_{res}$, and decreasing L increases $f_{res}$. In addition to the above, one of ordinary skill in the art may use any one of several three-dimensional electromagnetic software simulation programs available on the market to simulate different dimensions of the patch antenna and to find dimensions which provide the desired operating frequency. Such software is readily available and manufactured by a number of companies, and the task can be carried out relatively easily and without undue experimentation by one of ordinary skill in the art.

In the case of a square antenna element, we have $W=L \approx L_{eff} - d_S$. This poses some additional complexity in using formulas [A1] and [A2] since $\epsilon_{r,eff}$ becomes depends upon $L_{eff}$ in this case. One can apply a few iterations between equations [A1] and [A2] to generate a value of $L_{eff}$ for a desired resonant frequency. As an example, we first estimate $\epsilon_{r,eff}$ as $\epsilon_{r,eff}=1+0.75 \cdot (\epsilon_r - 1)$, and then use this estimated value in equation [A1] to find an initial estimate of $L_{eff}$. We can then take this estimated value of $L_{eff}$, subtract $d_S$ to provide a value of W that is used in equation [A2] to find a better estimate of $\epsilon_{r,eff}$. This better estimate of $\epsilon_{r,eff}$ is then used again in equation [A1]. An additional iteration may be carried out.

The location of the feed point to the antenna element does not substantially affect the resonant frequency, but it does substantially affect the level of input impedance at the resonant frequency. A location at the edge gives the maximum impedance, and a location at the center gives zero impedance. To choose an initial approximation of the feed point location for a desired level of input impedance, one may use a simple transmission line model (See for example, "Microstrip Antenna Design Handbook" by Ramesh Garg, Prakash Bhartia, Inder Bahl, Apisak Ittipiboon; 2001 Artech House, Inc, pp. 80–82; 115). According to this model the real part of the input impedance of a microstrip radiator at the resonant frequency will be:

$$R_{in} \approx \frac{1}{2 \cdot G} \cos^2(\beta \cdot L_1) \quad \text{[A3]}$$

where

G is an approximation of the real part of the edge admittance of a microstrip radiator:

$$G = \begin{cases} W^2/(90\lambda_0^2) & \text{for} \quad W \le 0.35\lambda_0 \\ W/(120\lambda_0) - 1/(60\pi^2) & \text{or} \quad 0.35\lambda_0 \le W \le 2\lambda_0 \\ W/(120\lambda_0) & 2\lambda_0 < W; \end{cases}$$

W—width of the microstrip radiator, $$\beta = \frac{2\pi}{\lambda_0\sqrt{\varepsilon_{eff}}}$$

Propagation constant of a microstrip line that corresponds to the microstrip radiator; and $L_1$—The distance from the feed point to the closest edge of the radiator.

If desired input resistance is given, then one can estimate the feed point position by solving equation [A3] relative to $L_1$:

$$L_1 \approx \frac{1}{\beta}\arccos\left(\sqrt{2R_{in}\cdot G}\right).$$

The 3-d simulation software can also be used to help one select the location of the feed point for a desired level of input impedance at the resonant frequency.

The dimensions of a circular antenna element may be estimated from a square antenna element having a patch area equal to the patch area of the circular antenna element.

APPENDIX B: Description of Down/Up Ratio

FIG. 7 shows a chart of the down/up ratio of the present invention and those of several prior art devices as a function of the elevation angle θ, which is the angle between the direction from the antenna to the horizon and the direction from the antenna to the satellite. A value of θ=0 degrees means that the satellite signal is parallel to the Earth's surface at the location of the antenna, and a value of θ=+90 degrees means that the satellite signal is directly above the antenna (at the zenith). In a down/up measurement, a test signal is transmitted to the antenna from a test source, which emulates the satellite broadcast signal. The source is moved in a large half-circle about the antenna as the signal is being transmitted. The test is conducted in a special chamber, an anechoic chamber, where wave reflections are minimized. One end of the half-circle lies directly below the antenna with a value θ=−90 degrees, and the other end lies directly above the antenna with a value of θ=+90 degrees. The test half-circle lies in a plane that is perpendicular to the Earth's surface, and that passes through the center point of the antenna. The radius of the test half-circle is much larger than the dimensions of the antenna. As the source is moved in the circle, the signal power received by the antenna is measured.

Test signals that are transmitted from directions above the horizontal level (also called horizon level) of the ground plane emulate the directly received signals. These test signals have angles θ which range between 0° and +90°. Test signals that are transmitted from directions below the horizontal level of the ground plane emulate multipath signals. These test signals have angles θ which range between 0° and −90°. The down/up ratio for an angle value of θ is equal to the ratio of the signal power received by the antenna at a source angle of −θ divided by the signal power received by the antenna at a source angle of θ. Thus, the down/up ratio is the multipath signal power divided by the signal power of the directly received signal as measured at equal angles from the horizon, and as measured with equal transmitted power levels. A lower down/up ratio means more reduction of the multipath signal. Since the ratio is with power levels, the down/up ratio is often provided in units of dB (decibels).

As a practical matter, the down/up measurement is usually made with the test source held in a fixed position and with the antenna being rotated rather than the source being rotated. As a further practical matter, the test source and antenna are usually disposed so that the axis between them is horizontal rather than vertical.

What is claimed is:

1. An antenna system for receiving radio signals, said antenna system comprising:

a signal port that outputs radio signals received by said antenna system;

a first ground plane having a first surface and a second surface opposite to the first surface;

a first antenna element disposed closer to the first surface of the ground plane than the second surface, the first antenna element having a first degree of electrical coupling to the signal port; and a second antenna element disposed closer to the second surface of the ground plane than the first surface, the second antenna element having a second degree of electrical coupling to the signal port; and wherein the first and second degrees of electrical coupling are not equal.

2. The antenna system of claim 1 wherein the first antenna element is conductively isolated from the signal port and the second antenna element is electrically coupled to the signal port.

3. The antenna system of claim 1 wherein the second antenna element has a first frequency at which it has a peak input resistance value with respect to the first ground plane; and wherein, at the first frequency, the second antenna element has a greater degree of electrical coupling to the signal port than the first antenna element has.

4. The antenna system of claim 1 further comprising a second ground plane disposed between the second antenna element and the first ground plane.

5. The antenna system of claim 4 further comprising a first dielectric body disposed between the first antenna element and the first ground plane, and a second dielectric body disposed between the second antenna element and the second ground plane.

6. The antenna system of claim 1 further comprising a first dielectric body disposed between the first antenna element and the first ground plane, and a second dielectric body disposed between the second antenna element and the first ground plane.

7. The antenna system of claim 1 wherein the first antenna element is coupled to the first ground plane by a conductive path.

8. The antenna system of claim 1 wherein the widest dimension of the first ground plane is less than or equal to 80 mm.

9. The antenna system of claim 1 wherein the widest dimension of the first ground plane is less than or equal to 65 mm.

10. The antenna system of claim 4 wherein the second antenna element has a first frequency at which it has a peak input resistance value with respect to the second ground plane, wherein the first antenna element has a resonant frequency with respect to the first ground plane, and wherein the resonant frequency is within −60 MHz to +25 MHz of the first frequency.

11. The antenna system of claim 4 wherein the second antenna element has a first frequency at which it has a peak input resistance value with respect to the second ground plane, wherein the first antenna element has a resonant frequency with respect to the first ground plane, and wherein the resonant frequency is within −5% to +2% of the first frequency.

12. The antenna system of claim 1 further comprising a zenith down/up ratio associated with the signal output at the signal port, and wherein the second antenna element has a first frequency at which it has a peak input resistance value with respect to the first ground plane, and wherein the zenith down/up ratio has a second frequency at which the zenith down/up ratio has a minimum value, the second frequency being within −40 MHz to +25 MHz of the first frequency.

13. The antenna system of claim 1 further comprising a zenith down/up ratio associated with the signal output at the signal port, and wherein the second antenna element has a first frequency at which it has a peak input resistance value with respect to the first ground plane, and wherein the zenith down/up ratio has a second frequency at which the zenith down/up ratio has a minimum value, the second frequency being within −3.5% to +2% of the first frequency.

14. The antenna system of claim 4 further comprising a zenith down/up ratio associated with the signal output at the signal port, and wherein the second antenna element has a first frequency at which it has a peak input resistance value with respect to the second ground plane, and wherein the zenith down/up ratio has a second frequency at which the zenith down/up ratio has a minimum value, the second frequency being within −40 MHz to +25 MHz of the first frequency.

15. The antenna system of claim 4 further comprising a zenith down/up ratio associated with the signal output at the signal port, and wherein the second antenna element has a first frequency at which it has a peak input resistance value with respect to the second ground plane, and wherein the zenith down/up ratio has a second frequency at which the zenith down/up ratio has a minimum value, the second frequency being within −3.5% to +2% of the first frequency.

16. The antenna system of claim 1 wherein the second antenna element has a first frequency at which it has a peak input resistance value at the signal port, and wherein the antenna system further comprises a zenith down/up ratio associated with the signal output at the signal port which is equal to or less than −10 dB at the first frequency.

17. The antenna system of claim 16 wherein the first ground plane has an area which is equal to or less than $\lambda^2/4$, where $\lambda$ is free-space wavelength of the first frequency.

18. The antenna system of claim 16 wherein the first ground plane has an area which is equal to or less than $\lambda^2/8$, where $\lambda$ is free-space wavelength of the first frequency.

19. The antenna system of claim 1 further comprising a first frequency at which the reception and coupling of radio signals to the signal port is a maximum; and a zenith down/up ratio associated with the signal output at the signal port which is equal to or less than −20 dB at the first frequency.

20. The antenna system of claim 19 wherein the first ground plane has an area which is equal to or less than $\lambda^2/4$, where $\lambda$ is free-space wavelength of the first frequency.

21. The antenna system of claim 19 wherein the first ground plane has an area which is equal to or less than $\lambda^2/8$, where $\lambda$ is free-space wavelength of the first frequency.

22. The antenna system of claim 1 further comprising a first frequency at which the reception and coupling of radio signals to the signal port is a maximum, and wherein the first ground plane has an area which is equal to or less than $\lambda^2/4$, where $\lambda$ is free-space wavelength of the first frequency of the antenna.

23. The antenna system of claim 1 further comprising a first frequency at which the reception and coupling of radio signals to the signal port is a maximum, and wherein the first ground plane has an area which is equal to or less than $\lambda^2/8$, where $\lambda$ is free-space wavelength of the first frequency of the antenna.

24. The antenna system of claim 1 wherein the second antenna element comprises a patch.

25. The antenna system of claim 24 wherein the ratio of the area of the first ground plane to the patch area of the second antenna element is less than 3.5.

26. The antenna system of claim 25 wherein the ratio of the areas is less than 2.5.

27. The antenna system of claim 24 further having a signal bandwidth associated with the signal output at the signal port, the signal bandwidth being greater than 3%.

28. The antenna system of claim 1 wherein the first antenna element comprises a patch.

29. The antenna system of claim 1 wherein the first antenna element comprises a flat patch disposed parallel to the first surface of the first ground plane, and wherein the second antenna element comprises a flat patch disposed parallel to the second surface of the first ground plane.

30. The antenna system of claim 1 further comprising a third antenna element disposed between the first ground plane and one of the first and second antenna elements.

31. The antenna system of claim 1 further comprising:

a third antenna element disposed between the first ground plane and the first antenna element, and a fourth antenna element disposed between the first ground plane and the second antenna element.

32. The antenna system of claim 31 wherein the first antenna element comprises a patch having a first area;

wherein the second antenna element comprises a patch having a second area;

wherein the third antenna element comprises a patch having a third area which is different from the first area; and wherein the fourth antenna element comprises a patch having a fourth area which is different from the second area.

33. The antenna system of claim 31 wherein the signal port is a first signal port, and wherein the antenna system further comprises:

a second signal port, the second signal port having unequal degrees of electrical coupling to the third and fourth antenna elements;

a first zenith down/up ratio associated with the signal output at the first signal port;

a second zenith down/up ratio associated with the signal output at the second signal port; and wherein the second antenna element has a first frequency at which it has a peak input resistance value with respect to the first ground plane, wherein the fourth antenna element has a second frequency at which it has a peak input resistance value with respect to the first ground plane, wherein the first zenith down/up ratio has a frequency at which the first zenith down/up ratio has a minimum value, said frequency of the first zenith down/up ratio being within −40 MHz to +25 MHz of the first frequency, and wherein the second zenith down/up ratio has a frequency at which the second zenith down/up ratio has a minimum value, said frequency of the second zenith down/up ratio being within −40 MHz to +25 MHz of the second frequency.

34. The antenna system of claim 31 wherein the signal port is a first signal port, wherein the antenna system further comprises a second signal port, the second signal port having unequal degrees of electrical coupling to the third and fourth antenna elements, wherein the second antenna element has a first frequency at which it has a peak input resistance value at the first signal port, wherein the fourth antenna element has a second frequency at which it has a peak input resistance value at the second signal port, and wherein the antenna system further comprises:

a first zenith down/up ratio associated with the signal output at the first signal port which is equal to or less than −10 dB at the first frequency; and a second zenith down/up ratio associated with the signal output at the second signal port which is equal to or less than −10 dB at the second frequency.

35. The antenna system of claim 34 wherein the second frequency is lower than the first frequency, and wherein the first ground plane has an area which is equal to or less than $\lambda^2/4$, where $\lambda$ is free-space wavelength of the second frequency.

36. The antenna system of claim 31 wherein the signal port is a first signal port, and wherein the antenna system further comprises:

a second signal port, the second signal port having unequal degrees of electrical coupling to the third and fourth antenna elements;

a first frequency at which the reception and coupling of radio signals from the second antenna element to the first signal port is a maximum;

a second frequency at which the reception and coupling of radio signals from the fourth antenna element to the second signal port is a maximum;

a first zenith down/up ratio associated with the signal output at the first signal port which is equal to or less than −20 dB at the first frequency; and a second zenith down/up ratio associated with the signal output at the second signal port which is equal to or less than −20 dB at the first frequency.

37. The antenna system of claim 1 further comprising:

a second ground plane disposed between the second antenna element and the first ground plane;

a third antenna element disposed between the first ground plane and the first antenna element, and a fourth antenna element disposed between the second ground plane and the second antenna element.

38. The antenna system of claim 37 wherein the first antenna element comprises a patch having a first area;

wherein the second antenna element comprises a patch having a second area;

wherein the third antenna element comprises a patch having a third area which is different from the first area; and wherein the fourth antenna element comprises a patch having a fourth area which is different from the second area.

39. The antenna system of claim 37 wherein the signal port is a first signal port, and wherein the antenna system further comprises:

a second signal port, the second signal port having unequal degrees of electrical coupling to the third and fourth antenna elements;

a first zenith down/up ratio associated with the signal output at the first signal port;

a second zenith down/up ratio associated with the signal output at the second signal port; and wherein the second antenna element has a first frequency at which it has a peak input resistance value with respect to the second ground plane, wherein the fourth antenna element has a second frequency at which it has a peak input resistance value with respect to the second ground plane, wherein the first zenith down/up ratio has a frequency at which the first zenith down/up ratio has a minimum value, said frequency of the first zenith down/up ratio being within −40 MHz to +25 MHz of the first frequency, and wherein the second zenith down/up ratio has a frequency at which the second zenith down/up ratio has a minimum value, said frequency of the second zenith down/up ratio being within −40 MHz to +25 MHz of the second frequency.

40. The antenna system of claim 37 further comprising a grounded enclosure disposed between the first and second ground planes.

41. An antenna system for receiving radio signals, said antenna system comprising:

a signal port that outputs radio signals received by said antenna system;

a ground plane;

a receiving antenna disposed above the ground plane and coupling an output signal to the signal port, the receiving antenna element havina a first degree of electrical coupling to the signal port; and a passive antenna disposed below the ground plane, the passive antenna element having a second degree of electrical coupling to the signal port; and wherein the first and second degrees of electrical coupling are not equal.

42. The antenna system of claim 41 wherein the receiving antenna has a first frequency at which the reception and coupling of radio signals to the signal port is a maximum, wherein the passive antenna has a resonant frequency, and wherein the resonant frequency is within −60 MHz to +25 MHz of the first frequency.

43. The antenna system of claim 41 wherein the receiving antenna has a first frequency at which the reception and coupling of radio signals to the signal port is a maximum, wherein the passive antenna has a resonant frequency, and wherein the resonant frequency is within −5% to +2% of the first frequency.

44. The antenna system of claim 41 further comprising a zenith down/up ratio associated with the signal output at the signal port, and wherein the receiving antenna has a first frequency at which the reception and coupling of radio signals to the signal port is a maximum, and wherein the zenith down/up ratio has a frequency at which the zenith down/up ratio has a minimum value, said frequency being within −40 MHz to +25 MHz of the first frequency.

45. The antenna system of claim 41 further comprising a zenith down/up ratio associated with the signal output at the signal port, and wherein the receiving antenna has a first frequency at which the reception and coupling of radio signals to the signal port is a maximum, and wherein the zenith down/up ratio has a frequency at which the zenith down/up ratio has a minimum value, said frequency being within −3.5% to +2% of the first frequency.

46. The antenna system of claim 41 further comprising a zenith down/up ratio associated with the signal output at the signal port, and wherein the receiving antenna has a first frequency at which the reception and coupling of radio signals to the signal port is a maximum, and wherein the zenith down/up ratio at the first frequency is less than the zenith down/up ratio of an instance of the receiving antenna operated in the absence of the passive antenna at the first frequency.

47. The antenna system of claim 41 further comprising a zenith down/up ratio associated with the signal output at the signal port, and wherein the receiving antenna has a first frequency at which the reception and coupling of radio signals to the signal port is a maximum, and wherein the zenith down/up ratio is equal to or less than −10 dB at the first frequency.

* * * * *